United States Patent [19]

van Huuksloot

[11] 4,143,901

[45] Mar. 13, 1979

[54] MECHANICAL GRAB

[75] Inventor: Leendert van Huuksloot, Zevenbergsehoek, Netherlands

[73] Assignee: Nemag, B.V., Rotterdam, Netherlands

[21] Appl. No.: 740,216

[22] Filed: Nov. 9, 1976

[30] Foreign Application Priority Data

Nov. 13, 1975 [NL] Netherlands ..... 7513279

[51] Int. Cl.[2] ..... B66C 3/01

[52] U.S. Cl. ..... 294/70; 37/187

[58] Field of Search ..... 294/70, 111; 37/71, 37/103, 106, 125, 127, 135; 214/145, 146 E, 147 C

[56] References Cited

U.S. PATENT DOCUMENTS

| | | | |
|---|---|---|---|
| 512,828 | 1/1894 | Hunt | 294/70 |
| 3,410,593 | 11/1968 | Goodman, Jr. | 294/70 |
| 4,047,313 | 9/1977 | Bricon | 294/70 |

FOREIGN PATENT DOCUMENTS

| | | | |
|---|---|---|---|
| 375492 | 6/1932 | United Kingdom | 294/111 |

*Primary Examiner*—James B. Marbert

*Attorney, Agent, or Firm*—Stevens, Davis, Miller & Mosher

[57] ABSTRACT

A mechanical grab consisting essentially of a frame within which round-bottomed scoops with straight-walled sides can be rotated about an axis in such a manner that, when the grab shuts, the mutually facing walls of the scoops are upwardly movable in overlapping relationship while the relative speed with which each of the scoops rotates about its axis is different.

6 Claims, 3 Drawing Figures

MECHANICAL GRAB

The invention relates to a mechanical grab which has been developed to be particularly suitable for picking up and transporting dusty materials, such as powders and other such dry substances.

A current problem is the removal of such materials without residue from ships, bunkers and similar storage places and their subsequent transport without leakage, using a grab. The effects of the weather, particularly of wind, must also be kept to a minimum. It is very desirable that work should proceed without adverse effect on the environment and that air and other pollution should be avoided as much as possible.

The grab according to the invention consists essentially of a frame within which scoops with rounded bottoms and straight-walled sides can be rotated about an axis in such a manner that, when the grab shuts, the mutually facing walls of the scoops are upwardly movable in overlapping relationship.

Since the invention makes provision for the scoops to close in overlapping relationship, their leading edges can be caused to pass practically along the ground, so that virtually all the material to be transported is picked up. Because the straight-walled sides, which are practically parallel to the ground at the commencement of the closing movement, are turned upward when the round-bottomed scoops enter into overlapping relationship, little material if any is spilt and the now enclosed contents of the grab will not be affected by the wind. These arrangements result in transport with virtually no loss of material.

In order to impart to the scoops the movement which is necessary to prevent them fouling each other, each is caused to rotate about its axis at a different speed. This can be arranged in a variety of ways, as will be explained below.

The movement of the scoops within the frame can be controlled in a simple and effective manner by the provision, in the side panels of the frame, of vertical guiding means for a carriage, the reciprocal movement of which controls the opening and closing of the scoops and the differential speed with which they may rotate about their axes.

The carriage is preferably connected to cables or the like, which are passed around pulleys or similar means which are secured to and turn together with the respective scoop in such a manner that, as the carriage rises, tractional forces are exerted on the scoops, causing them to rotate into the closed position.

Further details of the invention are given below in conjunction with the drawings, which are intentionally purely schematic in presentation.

Figure 3:
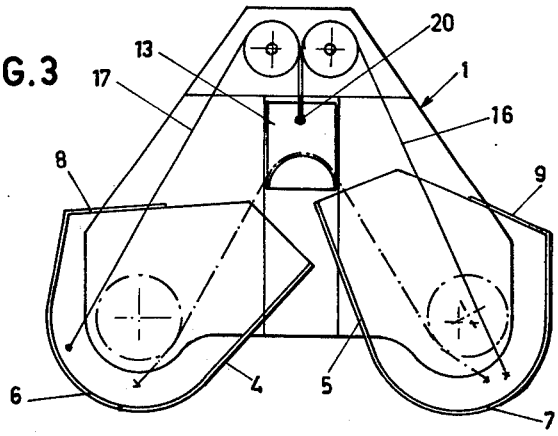

FIG. 3, the grab in the closed, transporting position.

In the drawing, 1 indicates the contour of the grab frame, which is not further detailed.

The scoops 2 and 3 are shaped as bins with straight-walled sides 4 and 5, rounded bottoms 6 and 7 and inclined straight retaining walls 8 and 9. Each scoop 2, 3 is rotatable about a shaft mounted in the frame 1, the respective shafts being indicated by their intersecting centre-lines. A pulley 10 is secured to either side of the scoop 2, and scoop 3 is similarly equipped with pulleys 11, these pulleys co-rotating with their respective scoops. The pulleys 11 are of smaller diameter than the pulleys 10 and the axes of the former are offset from the axis of the shaft of the scoop 3. The purpose of these arrangements, as illustrated in the drawing, are explained below.

The side panels of the frame 1 are provided with guiding means 12 in which a carriage 13 can travel up and down. This movement is controlled from the operator's cabin by appropriate means, which are not further specified. The carriage 13 bears a rounded beam or slide 14, over which a cable 15 is passed. This cable 15 is also passed around the pulleys 10 and 11 of the scoops 2 and 3 and is secured to each of the scoops at the points indicated. When the carriage 13, with its beam 14, travels upward from the position represented in FIG. 1, the pulleys 10 and 11, and with them the scoops 2 and 3, will begin to rotate in a direction such as to effect closure of the grab, since the cable 15 follows the upward movement of the carriage 13. As represented in FIG. 2, the straight-walled sides 4 and 5, after material has been picked up in the scoops 2 and 3, come to pass along and practically parallel to the ground and to overlap each other, the leading edges of the scoop 3 sliding inside those of the scoop 2. In this manner, effective sealing of the joins is achieved, which can be still further improved by the use of rubber. In order to prevent the scoops 2, 3 fouling each other in their continued movement toward the closed or transporting position shown in FIG. 3, the relative speed of rotation of the scoops 2, 3 is arranged to be different. This is the reason for the pulley 11 being smaller in diameter than the pulley 10. By offsetting the pulley 11 from the axis of rotation of the scoop 3, the desired effect is even better attained.

As FIG. 2 suggests, material can be picked up practically without residue, while the measures described above prevent its leakage.

The bin-like form of the scoops 2 and 3 ensures that the material is protected from the influence of the weather within an enclosed space. This, together with the panelling of the frame, likewise helps to keep environmental pollution to a minimum.

Cables 16 and 17 are secured to the scoops 2 and 3 close to their rounded periphery, these cables being passed around pulleys 18 and 19 and fixed at 20 to the carriage 13.

Figure 1:
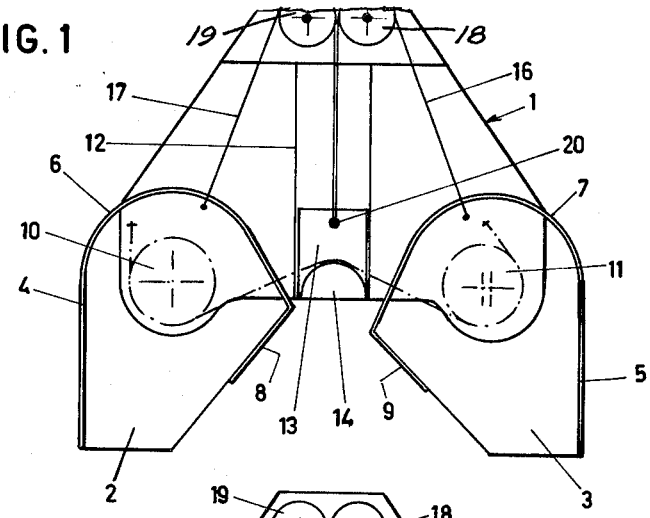
FIG. 1 represents a grab according to the invention in the completely open, discharging position.
Figure 2:
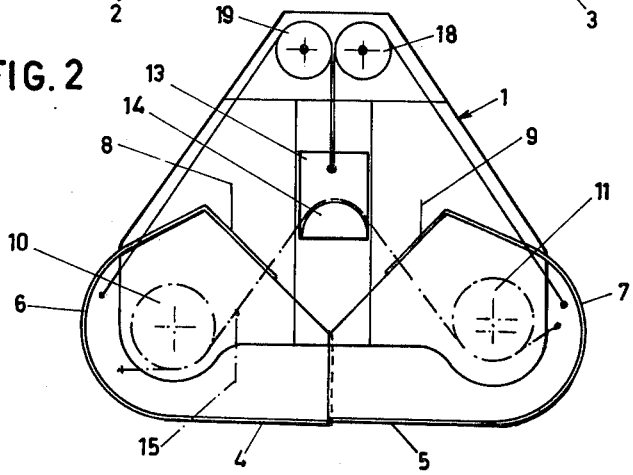
FIG. 2 represents the grab at the commencement of the closing movement.

When the carriage 13 descends from its position in the closed grab, as illustrated in FIG. 3, the scoops 2 and 3 are caused to rotate into the open position under the action of the cables 16 and 17, here assisted by the weight of the carriage, until the position shown in FIG. 1 is reached, at which point the scoops are completely emptied of material.

As the scoops 2 and 3 open, the carriage 13 travels downward, as indicated above, followed in its movement by the cable 15. Due to the chosen size and excentric disposition of the pulley 11, the scoops again rotate in such a manner that they do not obstruct each other.

I claim:

1. A mechanical grab consisting essentially of a frame, pivoting means mounted on said frame, two round-bottomed scoops with straight-walled sides pivotable on said pivoting means in such a manner that, when pivoting from an open position to a carrying position a pair of corresponding walls of the scoops in a separating position move together in overlapping relationship and then separate again, a pulley fixed to each scoop, one of said pulleys being smaller in diameter than the other so that the relative speed with which each of the scoops pivots is different.

2. The mechanical grab according to claim 1, including a carriage and wherein said frame includes side panels provided with vertical guiding means for said carriage, the reciprocal movement of said carriage controlling the opening and closing of the scoops and the differential speed with which the scoops pivot.

3. The mechanical grab according to claim 2, including cables connected to said carriage and passed around said pulleys in such a manner, that as the carriage rises, tractional forces are exerted on the scoops, causing them to pivot.

4. The mechanical grab according to claim 1, wherein the smaller pulley is offset from the pivot means of the scoop to which it is fixed.

5. The mechanical grab according to claim 2, including cables secured to the scoops close to their rounded periphery in such a manner that, when the carriage descends, tractional force is exerted on each scoop, causing it to pivot into the open position.

6. A mechanical grab consisting essentially of a frame, pivoting means mounted on said frame, and two round-bottomed scoops with straight-walled sides pivotable on said pivoting means in such a manner that, when pivoting from an open position to a carrying position a pair of corresponding walls of the scoops in a separating position move together in overlapping relationship and then separate again.

* * * * *